United States Patent [19]

Dominguez

[11] 4,452,150

[45] Jun. 5, 1984

[54] HOPPER CAR HATCH COVER

[76] Inventor: Danilo A. Dominguez, 1867 Piedras Cir., Danville, Calif. 94526

[21] Appl. No.: 377,720

[22] Filed: May 13, 1982

[51] Int. Cl.[3] ..... B61D 39/00

[52] U.S. Cl. ..... 105/377; 114/201 R

[58] Field of Search ..... 105/377; 114/201 R

[56] References Cited

U.S. PATENT DOCUMENTS

| | | | |
|---|---|---|---|
| 2,372,369 | 3/1945 | Ditchfield | 105/377 |
| 3,307,498 | 3/1967 | Stevens | 105/377 |
| 3,599,576 | 8/1971 | Vickerman | 105/377 |
| 3,605,639 | 9/1971 | Ingram | 105/377 |
| 3,664,270 | 5/1972 | Stark et al. | 105/377 |

*Primary Examiner*—Randolph Reese
*Assistant Examiner*—Gregory A. Beehner
*Attorney, Agent, or Firm*—Edward D. Gilhooly

[57] ABSTRACT

A trough hatch cover system employing one or more cover units pivotally mounted on a hopper car by hinge straps. The one or more cover units are formed with a corrugated panel having an end extrusion mounted at each end. The end extrusion strengthens the panel structure and provides a channel through which water collected on the corrugated panel can be drained. Closure members are used to secure the cover units in place and when closed create sealed contact with the end extrusions, whether at the ends of the hatch cover system or at the juncture between adjacent panels.

16 Claims, 9 Drawing Figures

HOPPER CAR HATCH COVER

BACKGROUND OF THE INVENTION

This invention relates in general to railroad equipment and, in particular, to means for covering the hatch opening typically provided in railroad hopper cars.

More specifically, but without restriction to the particular use which is shown and described, this invention relates to an improved trough hatch cover system.

Conventionally, railroad hopper cars are provided with openings in their roof construction through which the cars may be loaded to transport a wide range of materials. Many of these hopper cars have long narrow openings called trough hatches. Some trough hatches extend substantially the full length of the roof as one continuous opening, and other designs may include a series of separate openings in the roof. In any case, trough hatch openings facilitate the loading of bulk materials, such as grains, fertilizers, chemicals and minerals, using fixed nozzles from storage areas situated above the railroad car. Loading is accomplished by moving the cars relative to the nozzles to attain a generally uniform filling of the hopper to a desired level.

Numerous types of hatch covers have been employed in the prior art to cover a hopper car trough hatch opening. One common design for a hatch cover is directed to a molded unit made from fiberglass or other material and having perhaps ribs or other strengthening means. Molded type covers suffer from several deficiencies, of lack of mechanical properties to resist puncture, impacts at low ambient temperatures, and resistance to the sun's ultra violet rays all of which cause cracking and shattering of those materials. Known designs are also relatively costly to manufacture and possess limitations in versatility to accommodate a wide range of sizes and shapes of openings with one basic design. In addition, known covers tend to be inconvenient to use and do not attain optimum sealing when in a closed position.

SUMMARY OF THE INVENTION

It is, therefore, an obejct of this invention to improve hopper car trough hatch covers.

Another object of this invention is to provide a hatch cover design capable of being interchanged for use at any location on a railroad car roof.

A further object of this invention is to provide a hatch cover capable of covering a range of openings having different sizes and shapes.

Still another object of this invention is to form a hatch cover in a configuration to produce a suitably stiff, but flexible structure.

A further object of this invention is to provide a hatch cover capable of resisting impact and other forces.

Still another object of this invention is to provide means to strengthen the ends of the cover structure for better results and service.

A still further object of this invention is to provide a hatch cover which is relatively inexpensive to manufacture and lightweight for easy handling.

These and other objects are attained in accordance with the present invention wherein there is provided an improved hopper car trough hatch cover system formed from a metal panel which is formed with a plurality of flanges and corrugations to produce a still section, while maintaining some flexibility to deform as the hopper car flexes during operation. The panel structure of the cover of the invention is further strengthened by the use of a metal extrusion or cross member mounted at each end. The end members further act as draining means for water build-up on the panel structure. The design of the invention provides interchangeable cover components which permit use at any location on a car roof opening and may be employed with either round or square hatch openings, which shapes are commonly found in typical cars.

The invention of the application further includes means to achieve a highly effective seal over the hatch opening in a closed position of the cover system. The design of the novel cover disclosed herein permits economy of manufacture to reduce the expense of the cover system for use with railroad cars.

BRIEF DESCRIPTION OF THE DRAWINGS

Other objects of the invention together with additional features contributing thereto and advantages accruing therefrom will be apparent from the following description of a preferred embodiment of the invention, which is shown in the accompanying drawings, with like reference numerals indicating corresponding parts throughout, wherein.

DESCRIPTION OF A PREFERRED EMBODIMENT

Figure 1:
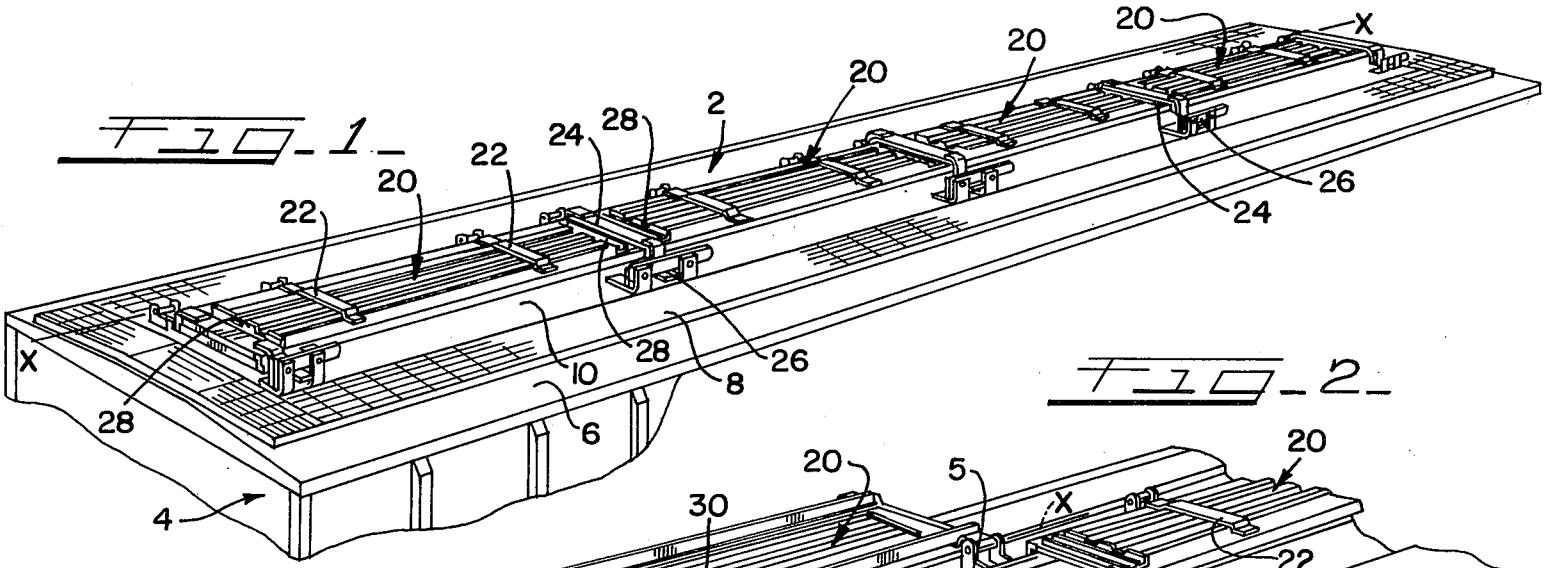
FIG. 1 is a side perspective view of the trough hatch cover system of the invention mounted on the roof of a railroad hopper car and shown in a closed position.
Figure 2:
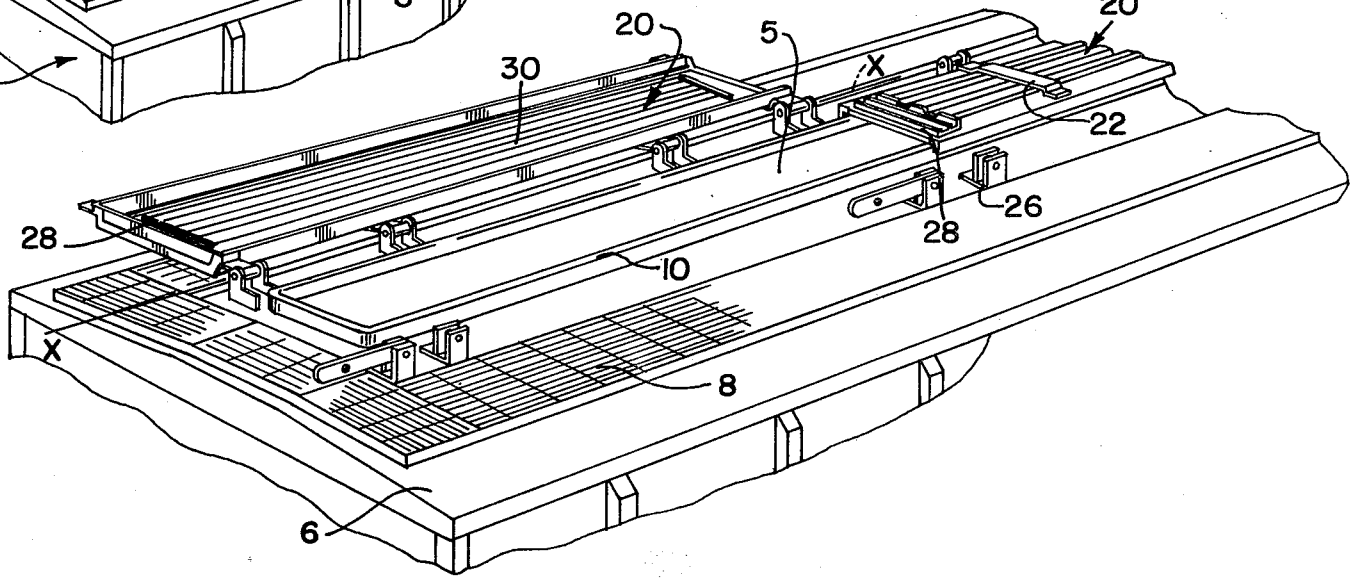
FIG. 2 is a partial side perspective view showing one of the hopper car hatch cover units of FIG. 1 in an open position.
Figure 3:
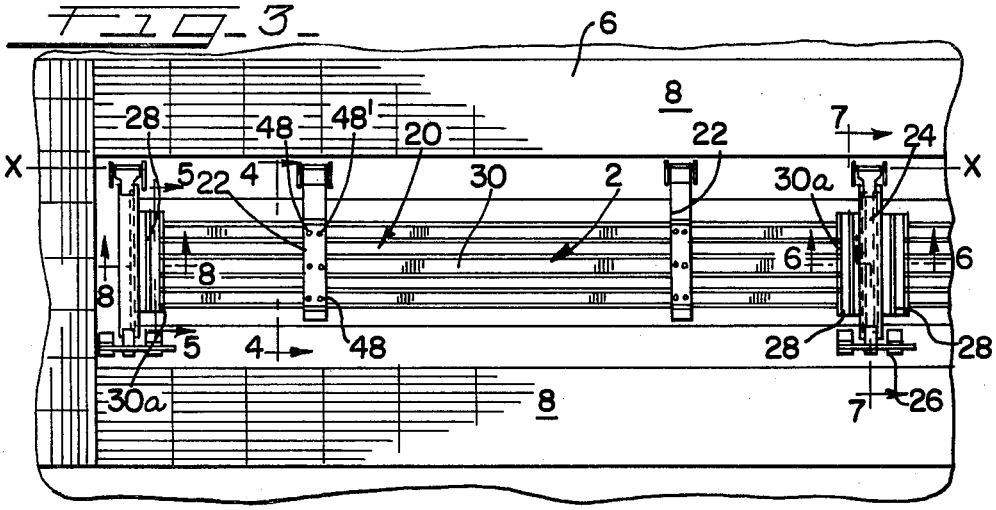
FIG. 3 is a top schematic view of one of the hatch covers of the invention in a closed position on a railroad hopper car.

Referring now to FIGS. 1 through 3, there is illustrated the improved hatch cover system 2 of the invention mounted on a railroad hopper car 4. Railroad hopper cars typically are formed with a trough hatch or opening 5 that extends the entire length of the car or alternatively, in a plurality of separate openings thereon. In any case, the invention of the application is capable of effectively covering either type of openings, whether formed with common round or square ends.

Trough hatch opening 5 (or a plurality of openings, if applicable) is situated in the roof structure 6 of the railroad car 4 and is bordered by running boards 8 as best shown in FIGS. 1 and 2. The running boards 8 are adjacent each side and the two ends of the hatch opening 5. The hatch opening 5 is defined on four sides by a hatch frame or coaming 10 having an upper rounded edge upon which the covers units of the hatch cover systems rest in sealed relationship to cover hatch opening 5. In FIG. 2 opening 5 is shown for purposes of illustration having square ends as opposed to rounded ends.

The trough hatch cover system 2 of the invention is designed to employ a plurality of separate cover units 20 in most situations, such as the four units which are illustrated in position on the roof of the railroad car 4 in FIG. 1. Other numbers of cover units 20, incuding a single unit, may be used in conjunction with the openings, depending on such factors as the length of each cover unit 20, the particular length of the railroad car and associated hatch opening, and the like. In any event, it is desirable that each trough hatch cover unit 20 is manufactured in the same length to provide the hatch cover system 2 of the invention with interchangeable components.

Each of the plurality of the trough hatch cover units 20 are provided with one or more pivotally mounted hinge straps 22 formed from steel and the like (two of which are shown for each cover unit 20 in FIG. 1). The straps are mounted for pivotal movement about the longitudinal axis x-x shown in FIGS. 1 to 3 and in turn carry the respective cover units 20 for swinging movement between an open position shown in FIG. 2 to a closed position over the hatch opening 5. A hatch closure or batten 24 is mounted for pivotal movement about axis x-x at each end of a respective hatch cover units. The hatch closures 24 act to engage the cover units 20 in the manner shown in FIG. 1 to secure the cover units in a locked configuration in association with a locking mechanism 26. As will be apparent latter, each of the hatch closures 24 cooperate with a respective end extrusion or cross member 28 attached to each end of cover unit 20 to create a sealed junction between adjacent cover units 20 or seal the two ends, and further provides water drain-off capability.

Figure 4:
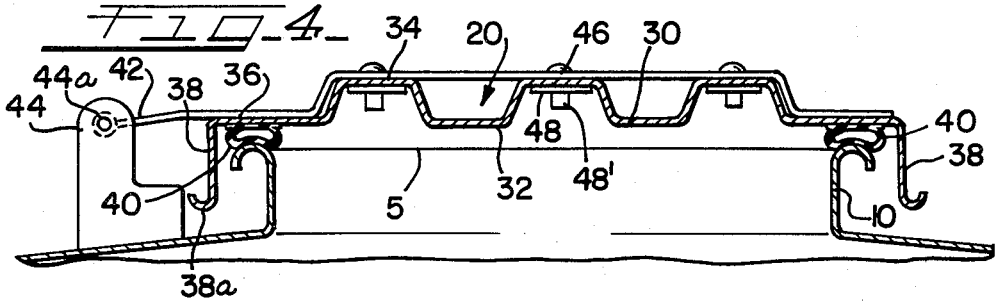
FIG. 4 is a sectional view taken along line 4—4 of FIG. 3.
Figure 5:
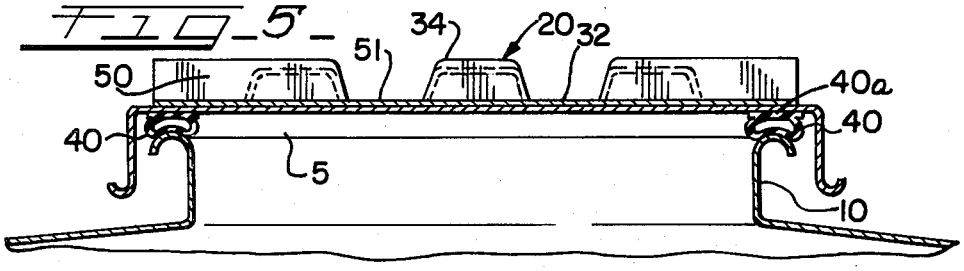
FIG. 5 is a sectional view taken along lines 5—5 of FIG. 3.

Referring now to FIGS. 3, 4 and 5 details of each cover unit 20 are best illustrated. Each of the cover units 20 include a main central section formed from a relatively thin sheet or panel 30 of material, such as, for example, a lightweight aluminum and the like. The panel 30 is formed with lengthwise corrugations which create low and high areas 32 and 34. The low areas 32 serve as runways for draining water off of the cover unit 20 as it accumulates thereon. The side border sections 36 of panel 30 extend outward beyond the coamings 10 in a closed position of the cover unit 20 and include downwardly disposed flanges 38. The flanges 38 terminate with upwardly curled ends 38*a*.

A continuous elastomeric gasket or seal 40 is affixed by a suitable technique to the underside of the border sections 36 and are provided with a hollow center 40*a* to cause the weight of the unit 20 and the force generated by the locked hatch closures 24 to flatten the gasket against the coaming structure 10 into sealed relationship as shown in FIGS. 4 and 5. The gasket includes a flat upper surface 42 which provides an area which can be readily attached to sections 36 of the cover panel 30. Since the top of the gasket 40 is affixed in sealed relationship to the cover by suitable techniques and the bottom thereof is pressed against coaming 10 in a closed position, an effective seal for water, dust, or other foreign materials is created by the gasket 40 between the cover and coaming.

The gaskets 40 extend the full length of the cover units 20 of each of the sides thereof and across the width for use at any intermediate location on any type of trough hatch opening, or at the ends of square shaped hatch opening 5. The gaskets 40 are formed in arcs or semi-circular shapes for use at end locations of round-end hatch openings or such shapes at any intermediate location (not shown). From the foregoing, it should be apparent that gasket 40 is in contact, when the cover unit 20 is closed with the trough hatch coaming 10 at all locations.

In use of the invention, it is advantageous to attain some relationship between the number of cover units 20 and the number of openings 5, because the gasket 40 on the cover unit 20 should align with the ends of the hatch opening. It is necessary that the gasket at the end of the opening corresponds to the shape of the opening, i.e. square or circular end.

In FIG. 4, the configuration of hinge straps 22, which are illustrated as being mounted in pairs on cover units 20, is best illustrated. Each hinge strap 22 comprises an elongated member having an outboard end 42 pivotally mounted on an upright bracket assembly 44 attached to the roof 6. The bracket assembly 44 is provided with a shaft 44*a* upon which the tubular end 42 of the hinge strap 42 is suitably mounted to carry cover unit 20. The axis of rotation of shaft 44*a* coincides with the axis x-x of FIGS. 1 through 3. The central portion of the hinge strap 22 includes a raised area 46 to match the height of the raised corrugated section 34 of the panel structure 30.

The hinge straps 22 are affixed to cover panel 30 by a series of pairs of longitudinally aligned openings through the strap and the raised section 34. A stiffener plate 48 also having corresponding holes is mounted beneath the raised section 34 by a mechanical fastener assembly 48' affixing the hinge strap 22, raised section 34 and stiffener plate 48 together as a unit. The arrangement of the holes in the straps 22 is best shown in FIG. 3. It should be apparent that the corrugated construction of cover panels 30 combined with the presence of hinge straps 22 strengthens the cover units 20 to produce a stiff section having sufficient flexibiity for allowing the cover to deform and maintain seal of gaskets 40 against hatch coaming 10 in response to stresses and strains applied thereto as the hopper car 4 flexes during movement.

Figure 6:
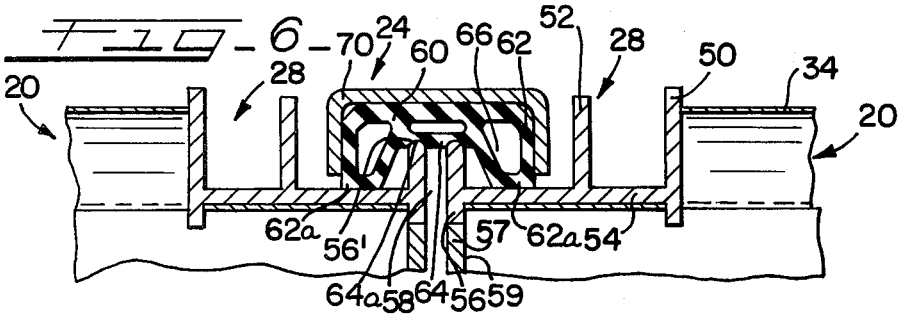
FIG. 6 is a sectional view taken along lines 6—6 of FIG. 3.

The formed sheet 30 of each cover unit 20 is further strengthened through the use of a cross member or end extrusion 28 which is positioned in cutout areas 30*a* provided at each end of the panel 30. A unitized coupling between the extrusion 28 and the panel 20 is obtained by welding and the like. The end extrusions 22 not only strenghten the formed panel 30, but act as drains for water accumulated on the cover system 2 and further aids in sealing the end of the cover unit 20 as will be apparent. Although extrusion 28 may be an aluminum member, it is within the scope of the invention to use other suitable materials, such as steel to fabricate this component. Each end extrusion or cross member 28 includes an inner vertical wall 50 and an intermediate vertical wall 52 which both integrally extend from a horizontal base plate 54, with wall 50 also having a segment extending beneath base plate 28. Extrusion 28 further is formed with an outboard upright wall 56 at the outer edge of base plate 56. As seen in FIG. 6 the wall 56 extends upward to a height less than the heights of walls 50 and 52.

The wall 50 is fabricated with a pair of cutout areas or ports 51 (FIG. 5) which are aligned with the low areas 32 of the formed cover panel 30 to create fluid communication therebetween. Any water which is collected in low areas 32 of the panel 30 because of rain and the like is induced to flow outward from low area 32 into the channel created between walls 50 and 52 and is drained laterally away from the cover structure. The cross member 28 is also provided with an end closure 57 (FIGS. 6, 8 and 9) that extends outward from both ends thereof. Accordingly, each cover unit 20 is formed with four end closures 57 and aid sealing with the gasket. End extrusions 28 of adjacent cover units 20 are shown spaced apart by a gap 58 to facilitate the opening and closing of each adjacent cover unit 20. The gap 58 is sealed by means of an elongated gasket 60 which is provided on the underside of closure member 24.

The gasket 60 is formed in a configuration to permit the seal to extend along the adjoining vertical walls 56 of end extrusions 28 and achieve a fluid tight seal therewith and with a portion of the base plate 54 when the cover unit 20 and closure member 24 are in a closed and secured relationship. The end closures further cooperate with end closures 57 for sealing. To accomplish this function the gasket 60 comprises an elongated member constructed of an elastomeric material and having lower leg-like portions 62 to provide a bottom surface 62*a* to bear against the base plate 54 of end extrusion 28. A lower section 64 having a pair of notches 64*a* are cutout of the central bottom portion of gasket 60, so that the gasket can engage the upper rounded edge of walls 56' at notches 64*a*, as shown in FIG. 6. Thus, the engagement of the bottom portions 62*a* with the base plates 54 and notches 64*a* creates a seal between the outside of the roof 6 and the gap 58 between the end extrusions 28. The interior gasket 60 further can be formed with suitable voids 66 as is well-known in the construction of such gaskets.

The gasket 60 is maintained in sealing relationship with the end extrusions 28 and end closures 57 by hatch closures 24 being locked in a closed position. The hatch closures 24 possess an approximate inverted U-shaped configuration 70 which substantially corresponds to the upper exterior configuration of gasket 60 to create a matching engagement. The gaskets 60 are secured to the underside of the hatch closure 24 and will move with the hatch closure when it is pivoted upward and then down on the running board to permit opening of the hatch cover units 20.

Figure 7:
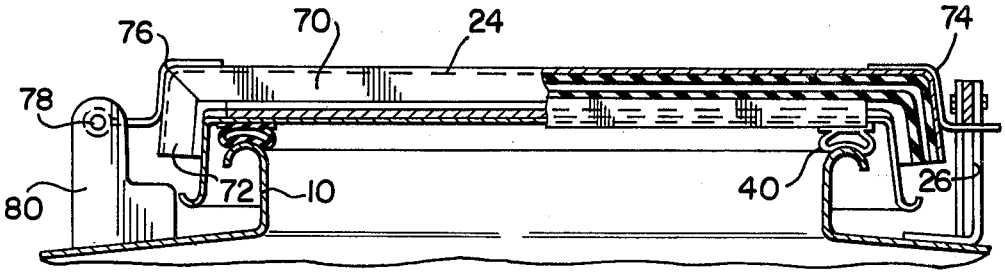
FIG. 7 is a sectional view taken along lines 7—7 of FIG. 3.

In FIG. 7 the construction of the hatch closure 24 is shown. As stated previously, the hatch closure 24 has a U-shaped cross section including downwardly disposed edge sections 72. A pair of members 74 and 76 having a bent cross sectional configuration to form upper and lower horizontal segments are respectively welded or otherwise affixed to the ends of the hatch closures 24. One of the members 76 includes a tubular outer end 78 to allow the closure member 24 to be pivotally mounted on a shaft of upright bracket 80, which is attached to the roof of the hopper car. As is apparent in FIG. 7, the hatch closure 24 may be lifted or lowered and swung about the axis x-x. The opposite member 74 is adapted to engage locking mechanism 26 which can comprise any typical design. It should also be apparent that when the closure members 24 are released and swung back away from the cover unit 20, they act as supports on the running board upon which the cover units 24 themselves may be swung in an open position, such as shown in FIG. 1. Hatch closures 24 are positioned between each adjacent pair of cover units 20 and at both ends of the system 2.

Figure 8:
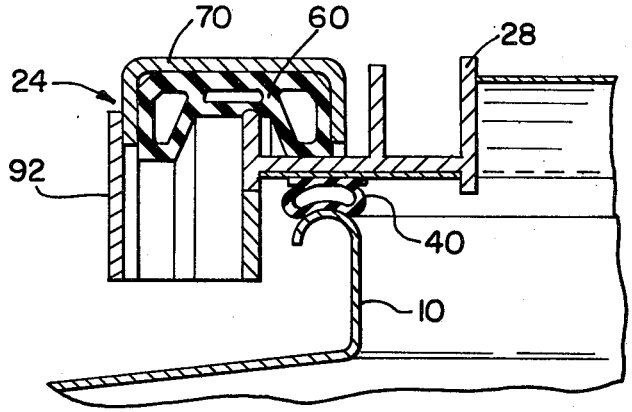
FIG. 8 is a sectional view taken along lines 8—8 of FIG. 3.
Figure 9:
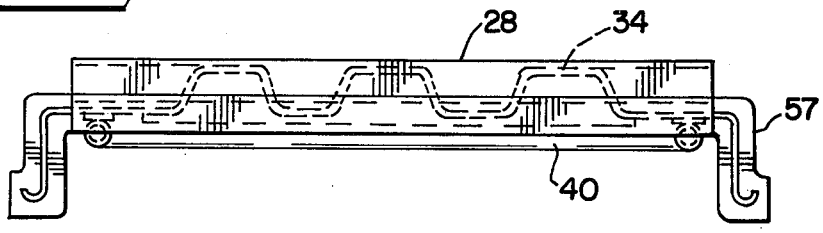
FIG. 9 is an end schematic view of one of the vertical walls of the cross member taken along lines 9—9 of FIG. 3.

Referring now to FIGS. 8 and 9 the means for sealing the ends of the hatch cover system 2 is shown. The seal 40 extends laterally and is suitably affixed to the bottom cross member 28. A closure plate 92 is attached to each closure member 24 located at each end of trough opening and aids in sealing the ends of the hatch cover system 2.

In use of the hatch cover system of the invention, the locked cover units 20, such as the four in number shown in FIG. 1, are first released by opening the hinged hatch closures 24 and pivoting them back onto the running board 8. These hatch closures 24 will act as supports for the two ends of the cover units 20 that are swung open down on the top of the hinge closures 24 as further illustrated in FIG. 1. The central areas of the opened cover units 20 will be supported on the running board by the hinge straps 22, such that each cover unit will be supported by at least two hatch closures 24 and two hinge straps 22.

The design of the hatch cover system of the invention is capable of being economically manufactured which reduces its overall cost of production. Although the invention of the application may be manufactured by other techniques, by one method sheets of aluminum or the like are drawn from large rolls of coils and are directed by known means through a roll-forming machine, in which the sheets are formed into the configuration shown in the drawings and during the same operation the panels 30, are fabricated by being cut to individual required lengths and the cutout section 30*a* is made in a conventional manner at each end of the individual panels or sheets 30. Thus, the sheets 30 can be formed, cut to required lengths, and cutout in the roll-forming operation without further fabrication and handling. The cutout areas are designed to receive the end cross member 28 which may be extruded or otherwise fabricated in a known manner and affixed to the sheets or panel 30 at cutout area 30*a* by welding and the like. The foregoing process is significantly less expensive and more efficient than individually molding separate fiberglass or metal covers that has been done heretofore.

While the invention has been described with reference to a preferred embodiment it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A hatch cover assembly comprising:

panel means for forming a cover of a hatch opening provided in the roof of a railroad car;

a pair of end cross members respectively affixed to the ends of said panel means to add strength thereto;

at least a portion of said panel means having a corrugated surface;

strap means affixed to said panel means and extending thereacross at a position between said end cross members to further strengthen said panel means;

said strap means includes means to mount said panel means for pivotal movement on a railroad car;

said corrugated portion of said panel means forms low and high areas on the surface of said panel means, said low areas acting to collect water therein for drainage wherein said end cross members includes channel means disposed in fluid communication with said low areas to drain fluid therefrom, said channel means being formed by two vertical walls extending laterally, port means through one of said walls for creating fluid communication between said low areas and said channel means; and each of said end cross members form at least one channel to receive the fluid and drain the fluid along the end of the panel members.

2. The hatch cover assembly according to claim 1 wherein said strap means are affixed to said panel means at said corrugated surface.

3. The hatch cover assembly according to claim 1 wherein said strap means includes at least one elongated strap member extending across said panel means in substantially parallel relationship to said ends.

4. The hatch cover according to claim 1 further including a pair of pivotally mounted closure members movable between an open position and a closed position at which said panel means is secured in a closed position, said closure members respectfully arranged to operatively contact said cross members in said closed position.

5. The hatch cover assembly according to claim 4 further including gasket means affixed to the underside of said closure members to create a fluid-tight seal between said closure members and said cross members in a said closed position.

6. The hatch cover assembly according to claim 1 further including an elongated gasket affixed to a lower portion of said panel means, said gasket being aligned in a closed position of said panel means with the coaming structure in said closed position.

7. The hatch cover assembly according to claim 1 wherein said panel means includes a plurality of panel members mounted in an end to end relationship to cover the hatch opening, each of said panel members being mounted for pivotal movement by said strap means, said strap means including at least one strap member affixed to each of said panel members.

8. The hatch cover assembly according to claim 7 wherein one of said end cross members is affixed to the ends of each of said panel members.

9. The hatch cover assembly according to claim 8 further including closure members mounted for pivotal movement between an open and closed position, said closure members acting to secure said panel members in a closed position of closure members.

10. The hatch cover assembly according to claim 9 wherein some of said closure members contact a pair of cross members of adjoining panels in said closed position of said panel members and said closure member.

11. A hatch cover assembly comprising:

panel means for selectively covering the hatch opening provided in the roof of a railroad hopper car;

strap means for pivotally mounting said panel means on the hopper car for movement between an open position exposing the hatch opening and a closed position covering the hatch opening;

said panel means being strengthened at both of its opposite ends by an elongated cross member;

drain means on top of said panel means for draining fluid on said panel means in a longitudinal direction to said opposite ends;

said elongated cross member including channel means in fluid communication with said drain means to direct any fluid in a lateral direction along said opposite ends for drainage to the side of the railroad hopper car;

said drainage means includes at least one corrugated panel member forming alternate low longitudinal areas collecting the fluid to be drained to said channel means; and said channel means is defined by a pair of spaced upright walls formed on said cross member, said upright walls defining a lateral channel opening to the side of the railroad car.

12. The hatch cover assembly according to claim 11 wherein one of said walls includes one or more openings to create said fluid communication between said drain means and said channel means.

13. The assembly according to claim 11 wherein said cross member includes a flat base plate and three upright spaced walls disposed upward therefrom, two of said walls defining said channel means.

14. The assembly according to claim 13 wherein one of said two channel defining walls includes at least one cut out area creating fluid communication between said drain means and said channel means.

15. The assembly according to claim 14 wherein the upper edge of the third of said upright walls forms an edge arranged to contact a seal disposed across the end of said panel means.

16. The assembly according to claim 15 further including a sealing member arranged to create a seal with said edge for sealing the ends between two adjoining panel means on the end of one panel means and the latch opening; said sealing member further having a porion arranged to contact said base plate during contact with said edge.

* * * * *